US006223702B1

(12) United States Patent
Achenbach et al.

(10) Patent No.: US 6,223,702 B1
(45) Date of Patent: May 1, 2001

(54) INTERNAL COMBUSTION ENGINE

(75) Inventors: Karl-Jörg Achenbach, Biedenkopf; Ulrich Bertsch, Burgstetten; Jochen Betsch, Waiblingen; Thomas Hardt, Weinstadt; Hubert Schnüpke; Günther Zoll, both of Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/295,573

(22) Filed: Apr. 22, 1999

(30) Foreign Application Priority Data

Apr. 25, 1998 (DE) ..... 198 18 589

(51) Int. Cl.[7] ..... F02F 1/14

(52) U.S. Cl. ..... 123/41.71; 123/41.8

(58) Field of Search ..... 123/41.71, 41.72, 123/41.74, 41.79, 41.8, 41.29, 193.2, 196 R, 196 M, 195 H, 193.3, 41.83, 41.84

(56) References Cited

U.S. PATENT DOCUMENTS

| | | | | |
|---|---|---|---|---|
| 843,068 | * | 2/1907 | Brady | 123/41.8 |
| 2,078,499 | * | 4/1937 | Lungstrom | 123/41.8 |
| 2,183,527 | * | 12/1939 | Alarie | 123/41.8 |
| 2,417,448 | * | 3/1947 | Rouy | 123/41.8 |
| 2,464,462 | * | 3/1949 | Ricardo | 123/41.8 |
| 2,959,163 | * | 11/1960 | Hodkin | 123/41.8 |
| 3,659,569 | * | 5/1972 | Mayer et al. | 123/41.79 |
| 3,672,263 | * | 6/1972 | Mijanic | 92/144 |
| 4,446,827 | * | 5/1984 | Kubozuka | 123/195 R |
| 4,644,911 | * | 2/1987 | Hidaka et al. | 123/184.61 |
| 4,667,635 | * | 5/1987 | Lichtblau | 123/41.8 |
| 4,677,825 | * | 7/1987 | Fellows | 60/525 |
| 5,083,537 | * | 1/1992 | Onofrio et al. | 123/175 R |
| 5,176,113 | * | 1/1993 | Hama et al. | 123/41.79 |
| 5,207,188 | * | 5/1993 | Hama et al. | 123/41.79 |
| 5,251,578 | * | 10/1993 | Kawauchi et al. | 123/41.84 |
| 5,386,805 | * | 2/1995 | Abe et al. | 123/41.28 |
| 5,570,668 | * | 11/1996 | Hsu | 123/193.2 |
| 5,575,251 | * | 11/1996 | Bock | 123/193.3 |
| 5,852,992 | * | 12/1998 | Boggs et al. | 123/196 R |
| 5,887,558 | * | 3/1999 | Kampichler et al. | 123/193.2 |

FOREIGN PATENT DOCUMENTS

| | | |
|---|---|---|
| 1 234 095 | 2/1967 | (DE) . |
| 27 25 059 | 2/1978 | (DE) . |
| 35 12 106 | 10/1986 | (DE) . |
| 36 29 671 | 3/1988 | (DE) . |
| 40 29 427 | 4/1991 | (DE) . |
| 0437086 B1 * | 1/1995 | (EP) . |
| 1 394 766 | 11/1972 | (GB) . |
| 2-130246 | 5/1990 | (JP) . |

* cited by examiner

*Primary Examiner*—Willis R. Wolfe
*Assistant Examiner*—Hai Huynh
(74) *Attorney, Agent, or Firm*—Klaus J. Bach

(57) ABSTRACT

In an internal combustion engine comprising an engine block consisting of a crankcase, at least one cylinder sleeve extending from the crankcase and a coolant jacket disposed around the cylinder sleeve or sleeves and a cylinder head mounted on the engine block, the coolant jacket is a separate component consisting of a material lighter than the normally used cast iron jacket and is firmly engaged between the crankcase and the cylinder head which is mounted onto the cylinder sleeve or sleeves.

6 Claims, 4 Drawing Sheets

INTERNAL COMBUSTION ENGINE

BACKGROUND OF THE INVENTION

The invention relates to an internal combustion engine including an engine block with a cylinder head disposed thereon and including liquid cooled cylinders formed by cylinder sleeves extending up to the cylinder head and being surrounded by a coolant jacket.

DE 40 29 427 shows such an internal combustion engine, wherein the coolant jacket is part of the cylinder crankcase and the cylinder sleeves are inserted into the coolant jacket. In this arrangement, the force generated by the cylinder head bolts is transmitted to the crankcase at least partially by way of the coolant jacket.

It is the object of the present invention to provide an internal combustion engine with a reduced weight.

SUMMARY OF THE INVENTION

In an internal combustion engine comprising an engine block consisting of a crankcase, at least one cylinder sleeve extending from the crankcase, a coolant jacket disposed around the cylinder sleeve or sleeves and a cylinder head mounted on the engine block, the coolant jacket is a separate component consisting of a material lighter than the normally used cast iron jacket and is firmly engaged between the crankcase and the cylinder head which is mounted onto the cylinder sleeve or sleeves.

In the internal combustion engine according to the invention, the coolant jacket is separate from the crankcase and the forces generated by the cylinder head bolts are not transmitted through the coolant jacket, but through the cylinder sleeves. It is therefore possible to provide a coolant jacket of a lightweight material since no forces are transmitted through the coolant jacket, but the coolant jacket only delimits a coolant space around the cylinder sleeves. The coolant jacket may therefore consist of a plastic material such as a polyamide, a metal foam or another material of a lower specific weight than that of cast iron, which is normally used. As a result, the weight of the internal combustion engine is substantially reduced. Since the materials used for the coolant jacket generally also have a relatively low heat conductivity, very little heat is transferred through the coolant jacket.

Preferably, the coolant space is—like in the arrangement shown in DE 40 29 427—formed by an open channel disposed at the inner surface of the coolant jacket adjacent the outer surface of the respective cylinder sleeve. However, the open channel could basically also be formed in the outer surface of the cylinder sleeve and be delimited by the inner surface of the coolant jacket.

The invention can be used advantageously with an internal combustion engine having two or more cylinders arranged in line. In this case, the coolant jacket extends around the cylinder sleeves of all the cylinders, that is, the jacket has a number of cylindrical or partially cylindrical openings corresponding to the number of cylinder sleeves. In this way, the coolant jacket delimits a coolant space with the cylinder sleeve of each individual cylinder and the coolant spaces may have individual coolant supply connections at the top and individual coolant return connections at the bottom of the coolant jackets. As a result, individual cooling of the various cylinder sleeves is possible.

The cylinder sleeves may be arranged separate and spaced from each other in which case the coolant jacket may include separate cylindrical openings for the cylinder sleeves. Coil-like coolant flow passages may be formed around the cylinder sleeves between the coolant jackets and the cylinder sleeves. For the cooling of the webs between adjacent cylinder sleeves, the coolant jacket may include transverse passages, which are in communication at one end with a coolant supply and at the other end, with the beginning of a coolant flow passages.

In a particularly space saving arrangement, the cylinder sleeves are cast together integrally or arranged closely together. In this arrangement, the coolant jacket includes a number of partially cylindrical cavities whose inner surfaces extend around the respective cylinder sleeves up to the web disposed between the adjacent cylinder sleeves. In order to achieve an individual cylinder sleeve cooling in spite of the fact that in this arrangement the coolant jacket does not completely surround the individual cylinder sleeves, each inner surface area includes a coolant space in the form of a cooling passage which extends zig-zag-like from one side of the web around the cylinder sleeve to the other side. At the upper end of the coolant jacket, the cooling passage is in communication with a coolant supply and at the lower end of the coolant jacket, the cooling passage is in communication with a coolant return. For the cooling of the web, the web includes transverse passages which are arranged each between the beginning of a meander- or zig-zag-like cooling passage and a coolant supply.

The coolant jacket may include openings through which the cylinder head bolts extend. If these openings are used at the same time for returning the lubricant from the cylinder head back to the oil sump, it is possible to cool the lubricant in a simple manner by providing in the coolant jacket a chamber through which the lubricant flows and in which an oil cooler may be disposed for improved cooling of the oil returning to the oil sump. The oil cooler may be disposed in communication with the engine cooling circuit so as to be cooled thereby. Such an oil cooler may, for example, include at least one plate which is in heat transfer relation with a coolant supply pipe.

The invention will become more readily apparent from the following description of a particular embodiment thereof shown, by way of example, in the accompanying drawings.

DESCRIPTION OF A PREFERRED EMBODIMENT

An internal combustion engine includes a crankcase 1, a cylinder head 2, which is shown only schematically and, in the embodiment shown, a twin cylinder structure comprising two cylinder sleeves 3 and 4, which are combined to a unit or cast integrally. A coolant jacket 5 surrounds the two cylinder sleeves 3 and 4. The cylinder sleeves 3 and 4 are cast integrally with the crankcase and extend up to the cylinder head 2. The cylinder head 2 is mounted by cylinder head bolts onto the cylinder sleeves 3, 4. The forces generated by the cylinder head bolts are transferred through the cylinder sleeves 3 and 4. The coolant jacket is engaged between the cylinder head 2 and a support surface la on the crankcase 1. Gaskets (not shown) are disposed between the engagement surfaces of the coolant jacket 5 with the support surface la and the cylinder head 2.

Since the forces generated by the cylinder head bolts are transmitted through the cylinder sleeves 3, 4, and the coolant jacket is independent of the crankcase 1, the coolant jacket 5 may consist of a light-weight material. The coolant jacket is not subjected to any load, it serves only to form cooling passages with the coolant jacket as will be described below. The coolant jacket 5 may be composed of a plastic such as a polyamide, a metal foam or another material of a lower specific weight than that of the casting materials presently used.

Figure 1:
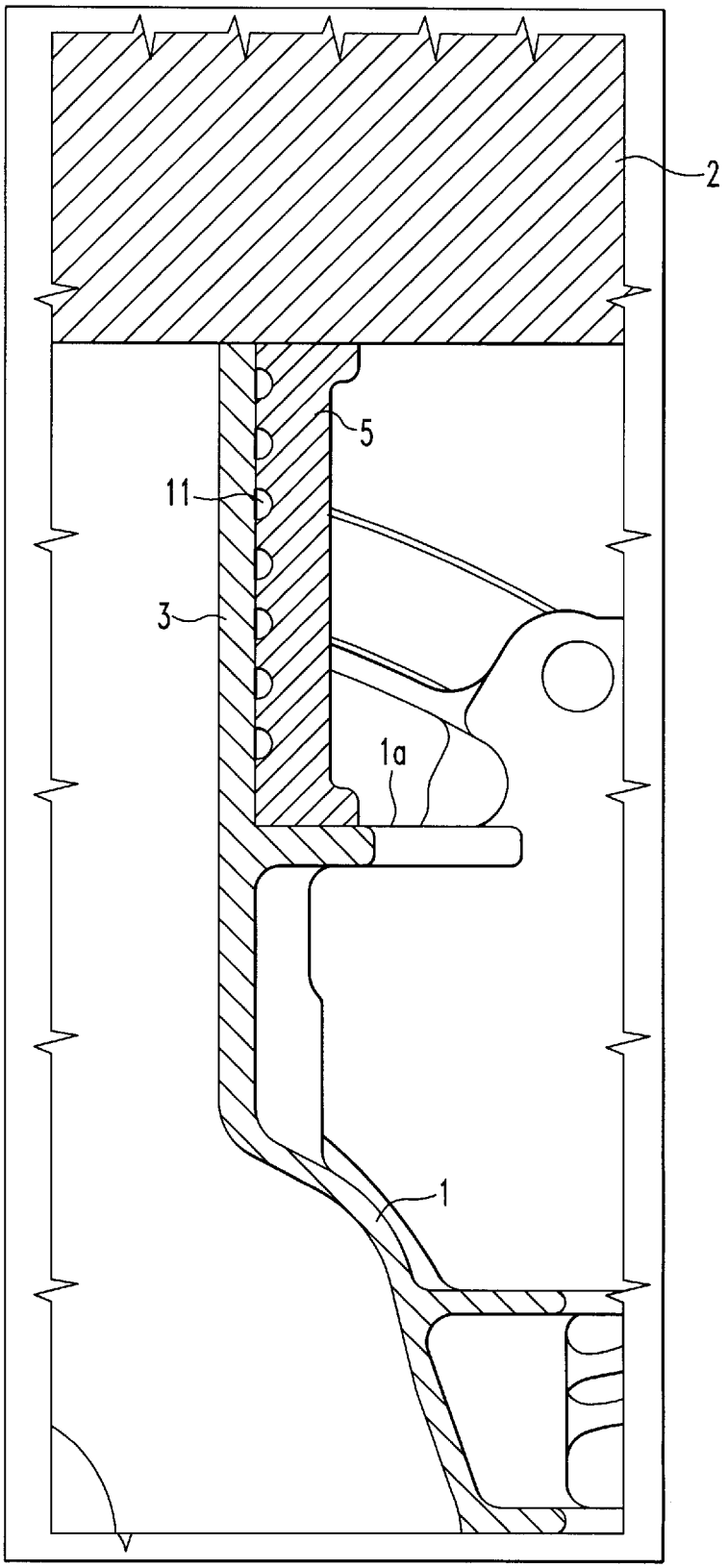
FIG. 1 is a partial cross-sectional view of an internal combustion engine taken along line 1—1 of FIG. 2.
Figure 2:
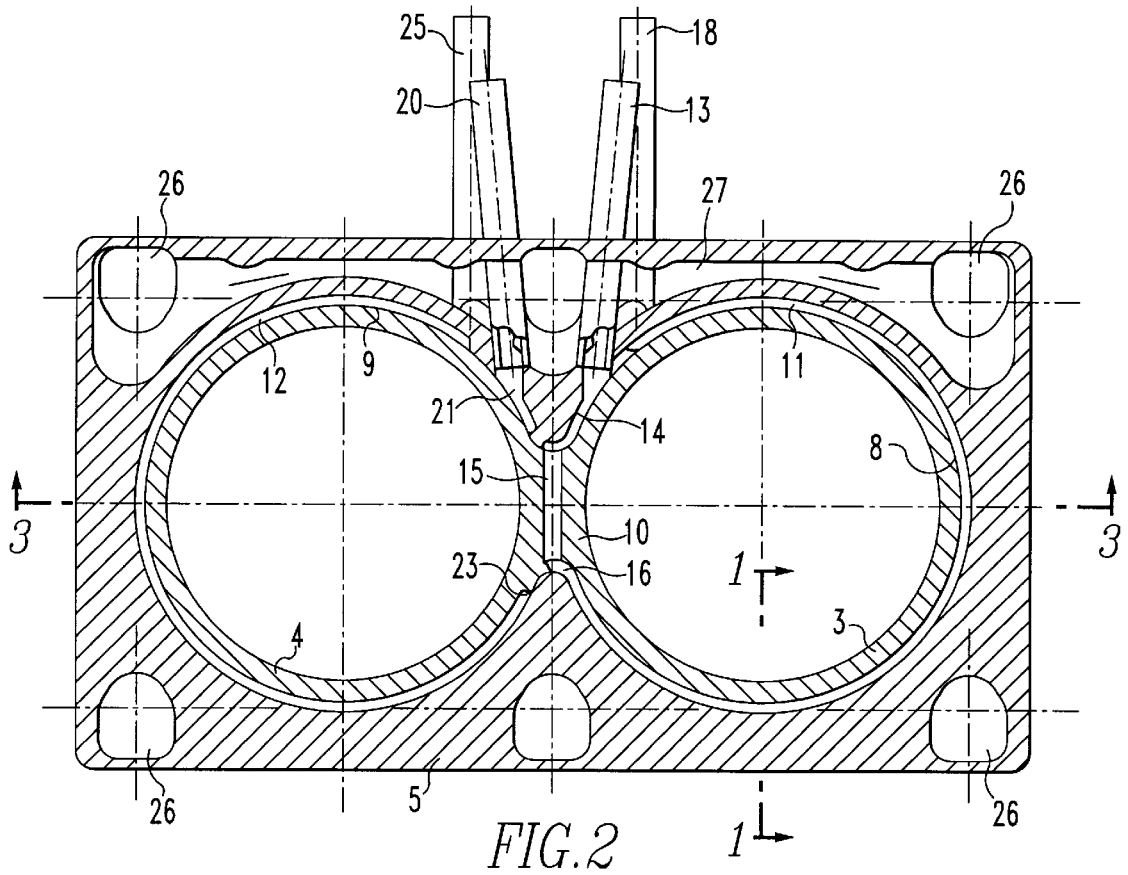
FIG. 2 is a cross-sectional view of a twin cylinder arrangement taken along line 2—2 of FIG. 3.
Figure 3:
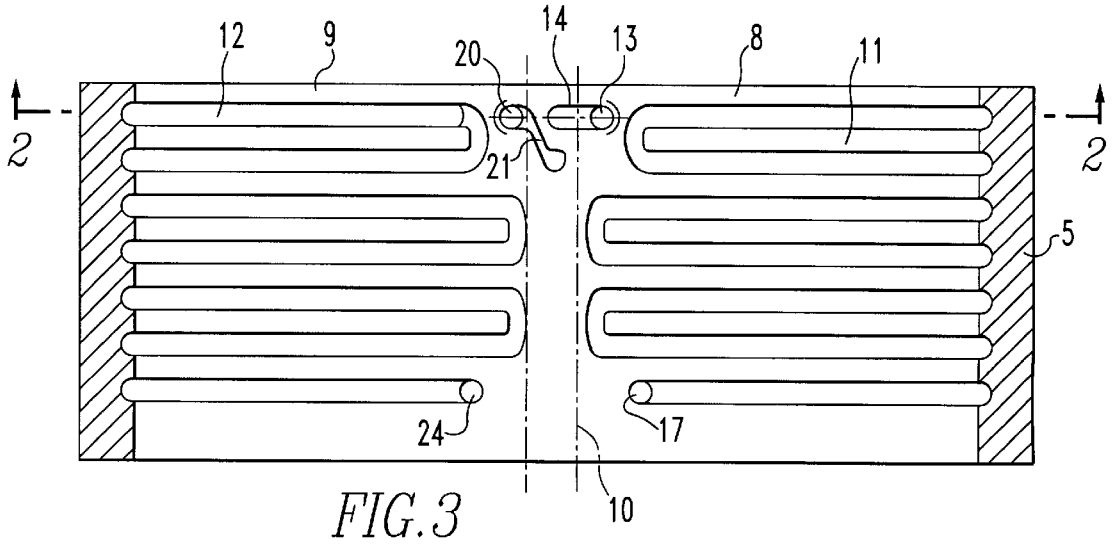
FIG. 3 is a cross-sectional view of a coolant jacket taken along line 3—3 of FIG. 2.

The coolant jacket 5 includes two partially cylindrical openings 6 and 7 (FIG. 4), whose inner surfaces 8 and 9 extend around the cylinder sleeves 3 and 4 respectively, up to the web 10 by which the two cylinder sleeves 3 and 4 are joined. In each inner surface 8, 9, there is an open cooling passage 11, 12, which extends in zig-zag form from one side of the web around the cylinder sleeve to the other side of the web 10, as it is shown in FIG. 3, in which the web 10 is indicated by dash-dotted lines. The cooling passages 11 and 12 are covered by the cylinder sleeves 3 and 4.

Figure 4:
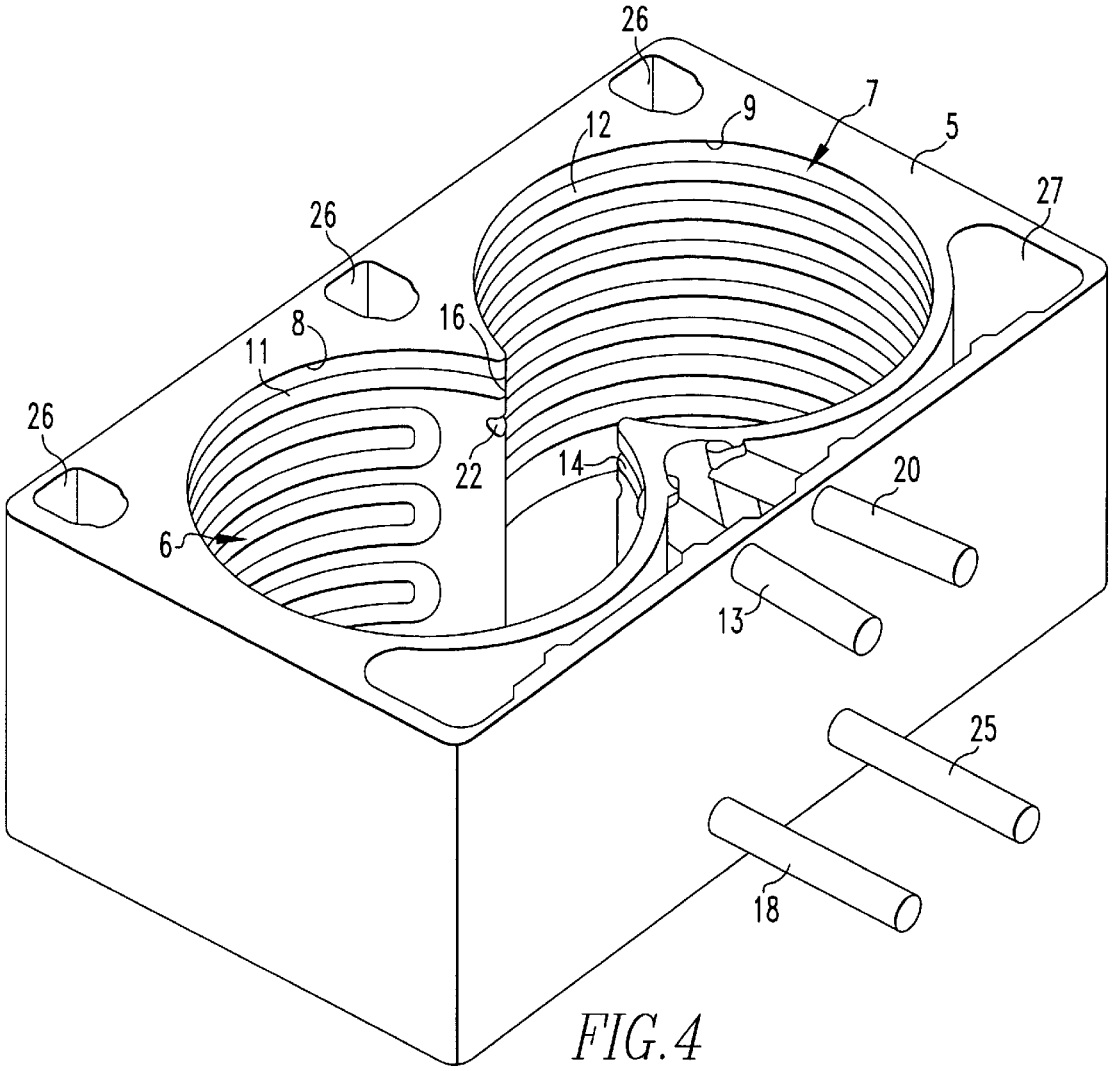
FIG. 4 is a perspective view of the coolant jacket.

To cool the cylinder sleeve 3, coolant is supplied to the cooling passage 11 by a coolant supply 13 which leads to a connecting passage 14 in the inner surface 8 defining the cylindrical opening 7. The coolant supply 13 is in communication with one end of a transverse passage 15 formed in the web 10 between the cylinder sleeves 3, 4. The other end of the transverse passage 15 leads to the upper end 16 of the cooling passage 11. The lower end 17 of the cooling passage 11 is in communication with a coolant return 18, which is arranged at the same side of the cylinders on the coolant supply 13, but is disposed there below as shown in FIG. 4. The coolant consequently flows from the coolant supply 13 through the connecting passage 14 and the transverse passage 15 to the cooling passage 11. It then flows through the cooling passages 11, 12 from the top to the bottom end of the cylinder sleeves and exits at the end 17 into the coolant return 18.

Cooling of the cylinder sleeve 14 is achieved in essentially the same way. Here, the coolant from a coolant supply 20 enters a connecting passage 21 formed in the inner surface 9 of the opening 7 and from there enters a transverse passage, which is not visible in the drawings, but which is disposed in the web 10 below. From the transverse passage, the coolant flows, by way of a connecting passage 21, to the upper end 23 of the cooling passage 12 and through the cooing passage 12 downwardly to its lower end 24. The end 24 is in communication with a coolant return 25, which is disposed on the same side as the coolant supply 20 but further below.

The transverse passages 15 provide for an intensive cooling of the thermally highly loaded web 10.

As it is apparent, each cylinder sleeve 3, 4 is individually cooled.

Since a single coolant jacket of light-weight material is provided for both cylinders, the weight of the engine is substantially reduced. This advantage is obtained even if the cylinder sleeves 3, 4 are individual parts which are not integrally formed, but are only disposed adjacent each other in the area of the web. In this case, the transverse passages may be formed in the adjoining surfaces. The cylinder sleeves 3, 4 may also be disposed in spaced relationship in which case the cylinder sleeves can be fully surrounded by the coolant jacket.

Figure 5:
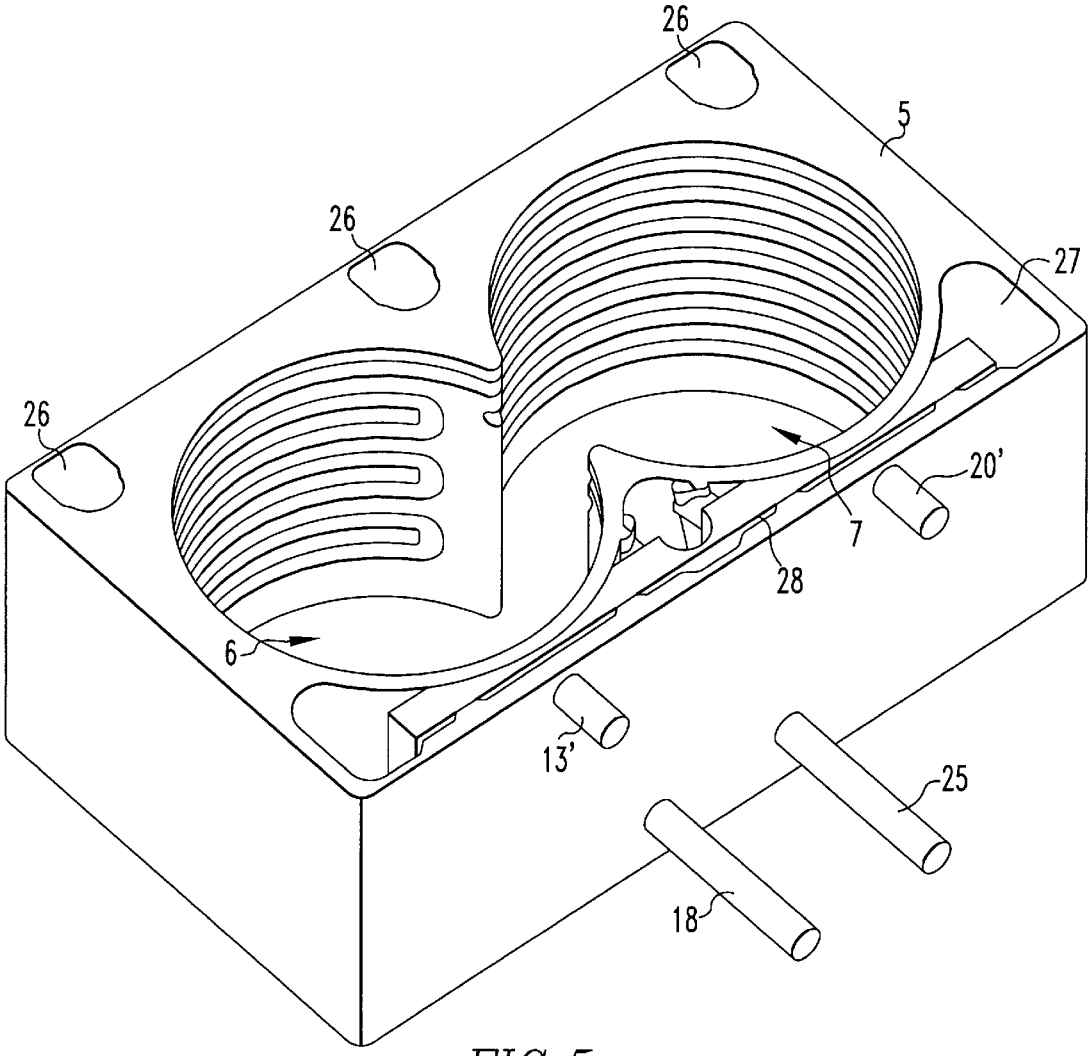
FIG. 5 shows, like FIG. 4, a coolant jacket having however an oil cooler disposed therein.

In the embodiment shown the coolant jacket 5 includes openings 26 for the reception of the cylinder head bolts, which are not shown in the drawings. The openings form at the same time return flow passages for the oil from the cylinder head 2 to the crankcase 1. At the same time, the returning oil is cooled. In order to achieve intense cooling of the returning oil in a simple manner, the coolant jacket may be provided with a chamber 27 through which the lubricant flows and in which an oil or lubricant cooler 28 is arranged as shown in FIG. 5. The oil cooler 28 has coolant supply connections 13' and 20', which extend through the chamber 27 for flowing coolant therethrough. The returning oil is in heat transfer contact with the oil cooler 28. The oil cooler 28 consists for example of at least one metal plate, which is attached to the tubular coolant supply connections 13', 20' which also consist of metal. In this embodiment, the coolant supply connections 13' and 20' are further spaced from each other then in the embodiment of FIG. 4. The coolant is conducted along the metal plate to the passages 14 and 21, respectively, in heat exchange relation with the oil in the chamber 27. The coolant supply connections extend through the chamber 27 over an increased distance so that a larger heat exchange surface area is provided there in the embodiment of FIG. 4.

The invention can of course be utilized also in an internal combustion engine having only one cylinder or an engine having more than two cylinders. The cylinder sleeves may be individual sleeves or several or all of the sleeves in a row of cylinders may be joined. If individual cylinder sleeves are used, the coolant jacket completely surrounds each cylinder sleeve and each cylinder sleeve can be surrounded by a cooling space or by cooling passages over its full circumference. The cooling passages in this case may extend spirally, that is coil-like, around the cylinder sleeves.

What is claimed is:

1. An internal combustion engine comprising an engine block consisting of a crankcase, at least two cylinder sleeves arranged in a row, a cylinder head mounted onto said at least two cylinder sleeves and a coolant jacket extending around said at least two cylinder sleeves, said cylinder sleeves being integrally cast adjacent one another with a web formed between adjacent cylinder sleeves and said coolant jacket having partially cylindrical openings corresponding to the number of cylinder sleeves of said engine, said openings having inner surfaces extending around said cylinder sleeves up to said webs formed between adjacent cylinder sleeves, and said inner surfaces including passage structures extending in a zig-zag form along the cylinder sleeves between said webs and said webs including transverse passages which are in communication, at one end, with the beginning of a zig-zig cooling passage and, at the other end, with a coolant supply connection.

2. An internal combustion engine according to claim 1, wherein said coolant jacket includes openings for the reception of cylinder head mounting bolts.

3. An internal combustion engine according to claim 2, wherein said cylinder head mounting bolt openings are sufficiently large so as to serve as lubricant return passages for returning lubricant from the cylinder head back to the crankcase and wherein said coolant jacket includes a chamber in communication with the mounting bolt openings and on oil cooler is disposed in said chamber.

4. An internal combustion engine according to claim 3, wherein said oil cooler comprises at least one plate which is disposed in heat conducting relationship with at least one coolant connection extending through said chamber.

5. An internal combustion engine according to claim 1, wherein said coolant jacket consists of a plastic material.

6. An internal combustion engine according to claim 1, wherein said coolant jacket consists of a foamed metal.

* * * * *